US011566849B2

(12) United States Patent
Huang

(10) Patent No.: US 11,566,849 B2
(45) Date of Patent: Jan. 31, 2023

(54) RESERVOIR AND LIQUID-COOLING RADIATOR

(71) Applicant: Dongguan Hanxu Hardware Plastic Technology Co., Ltd., Guangdong (CN)

(72) Inventor: Tsung-Hsien Huang, Dongguan (CN)

(73) Assignee: DONGGUAN HANXU HARDWARE PLASTIC TECHNOLOGY CO., LTD., Guangdong (CN)

( * ) Notice: Subject to any disclaimer, the term of this patent is extended or adjusted under 35 U.S.C. 154(b) by 40 days.

(21) Appl. No.: 17/315,373

(22) Filed: May 10, 2021

(65) Prior Publication Data

US 2022/0252354 A1 Aug. 11, 2022

(30) Foreign Application Priority Data

Feb. 9, 2021 (CN) ..... 202110174257.9

(51) Int. Cl.
*F28F 9/02* (2006.01)
*F28D 7/16* (2006.01)

(52) U.S. Cl.
CPC . *F28D 7/16* (2013.01); *F28F 9/02* (2013.01)

(58) Field of Classification Search
CPC ..... F28D 7/16; F28F 9/02
USPC ..... 165/175
See application file for complete search history.

(56) References Cited

U.S. PATENT DOCUMENTS 4,088,561 A * 5/1978 Anderson ..... G01N 27/44795 436/516
6,324,364 B1 * 11/2001 Nomura ..... G03G 15/751 399/116
2019/0072208 A1 * 3/2019 Liu ..... F16K 31/52483

* cited by examiner

*Primary Examiner* — Davis D Hwu
(74) *Attorney, Agent, or Firm* — Leong C. Lei

(57) ABSTRACT

A reservoir and a liquid-cooling radiator are disclosed. The reservoir includes a reservoir body and at least one partition mounted in the reservoir body. The reservoir body has an end panel and a peripheral side panel that is integrally formed and connected with the end panel. The peripheral side plate extends from a peripheral edge of the end panel in a same direction. A liquid chamber is formed and surrounded by the end panel and the peripheral side panel. The peripheral side plate has two side plate portions located on opposing two sides of the end panel. The reservoir body is formed with U-shaped strips extending along inner walls of one side plate portion, the end panel and the other side plate portion in sequence. The U-shaped strips are spaced and arranged in pairs. A groove is formed between the paired U-shaped strips.

10 Claims, 8 Drawing Sheets

RESERVOIR AND LIQUID-COOLING RADIATOR

BACKGROUND OF THE INVENTION

1. Field of the Invention

The present invention relates to a radiator, and more particularly to a reservoir and a liquid-cooling radiator.

2. Description of the Prior Art

A liquid-cooling radiator is configured to dissipate the heat of the radiator using a liquid under the action of a pump. Compared with air cooling, the liquid-cooling radiator has the advantages of quietness, stable cooling, and less dependence on the environment. The heat dissipation performance of the liquid-cooling radiator is proportional to the flow rate of a cooling liquid (water or other liquid). The flow rate of the cooling liquid is related to the power of the pump in the cooling system. Moreover, the heat capacity of liquid is large. This makes the liquid-cooling system have a good heat load capacity.

A conventional liquid-cooling heat dissipation device usually consists of a liquid-cooling radiator, a liquid-cooling block, and a liquid pipe. The liquid pipe is connected between the liquid-cooling radiator and the liquid-cooling block. The liquid pipe is configured to circulate the liquid in the liquid-cooling radiator and the liquid-cooling block. After the liquid absorbs heat of the liquid-cooling block, it flows into the liquid-cooling radiator to dissipate heat. The liquid after heat dissipation flows back into the liquid-cooling block.

In the prior art, the channels of the liquid-cooling radiator of the liquid-cooling heat dissipation device are U-shaped. This results in that the liquid travels a short distance in the liquid-cooling radiator, so the liquid-cooling radiator cannot effectively cool the liquid and dissipate heat. Therefore, it is necessary to improve the conventional liquid-cooling radiator. Besides, the reservoir of the conventional liquid-cooling radiator also needs to be improved. How to provide a reservoir with good separation and sealing properties, uniform surfaces and easy production for the liquids of the divisional liquid chambers of the reservoir not to be mixed with each other has become a subject that needs to be studied.

SUMMARY OF THE INVENTION

In view of the defects of the prior art, the primary object of the present invention is to provide a reservoir. The reservoir has good structural strength, uniform surfaces, good separation and sealing properties, so that the liquids in the divisional liquid chambers will not mix with each other, and it is easy to produce and suitable for popularization and application.

Another object of the present invention is to provide a liquid-cooling radiator, which can effectively solve the problem that the conventional liquid-cooling radiator cannot effectively cool the liquid and dissipate heat.

In order to achieve the above objects, the present invention adopts the following technical solutions:

A reservoir comprises a reservoir body and at least one partition mounted in the reservoir body. The reservoir body has an end panel and a peripheral side panel that is integrally formed and connected with the end panel. The peripheral side plate extends from a peripheral edge of the end panel in a same direction. A liquid chamber is formed and surrounded by the end panel and the peripheral side panel. An extension distal end of the peripheral side plate forms an opening of the liquid chamber. The peripheral side plate has two side plate portions located on opposing two sides of the end panel. The reservoir body is formed with U-shaped strips extending along inner walls of one side plate portion, the end panel and the other side plate portion in sequence. The U-shaped strips are spaced and arranged in pairs. A groove is formed between the paired U-shaped strips. The partition is inserted into the groove from the opening, and the partition is hermetically connected to the U-shaped strips, so as to divide the liquid chamber into divisional liquid chambers located on two sides of the partition.

A liquid-cooling radiator comprises a plurality of pairs of radiating pipes arranged side by side and two reservoirs as mentioned above on respective two ends of the plurality of pairs of radiating pipes. A reservoir cover is hermetically connected to the opening of the liquid chamber of the reservoir body. The partition is hermetically connected to an inner wall of the reservoir cover. The reservoir cover has mounting holes corresponding to the divisional liquid chambers. The two ends of the plurality of pairs of radiating pipes are respectively connected to the corresponding mounting holes to communicate with the corresponding divisional liquid chambers.

Compared with the prior art, the present invention has obvious advantages and beneficial effects. Specifically, it can be known from the above technical solutions.

The reservoir body is formed with the U-shaped strips extending its inner wall. The U-shaped strips are spaced and arranged in pairs. The groove is formed between the paired U-shaped strips. The partition is inserted into the groove from the opening, and the partition is hermetically connected to the U-shaped strips, so as to divide the liquid chamber into the divisional liquid chambers located on both sides of the partition. This reservoir has good structural strength, uniform surfaces, good separation and sealing properties, so that the liquids in the divisional liquid chambers will not mix with each other, and it is easy to produce and suitable for popularization and application.

In addition, the liquid-cooling radiator adopts the above improved reservoir, so that the channels in this product are connected in sequence to form a circuitous configuration. This allows the liquid to travel a longer distance in the liquid-cooling radiator, so that the liquid-cooling radiator can effectively cool the liquid and dissipate heat. The overall heat dissipation effect of the product is very good.

DETAILED DESCRIPTION OF THE PREFERRED EMBODIMENTS

Figure 1:
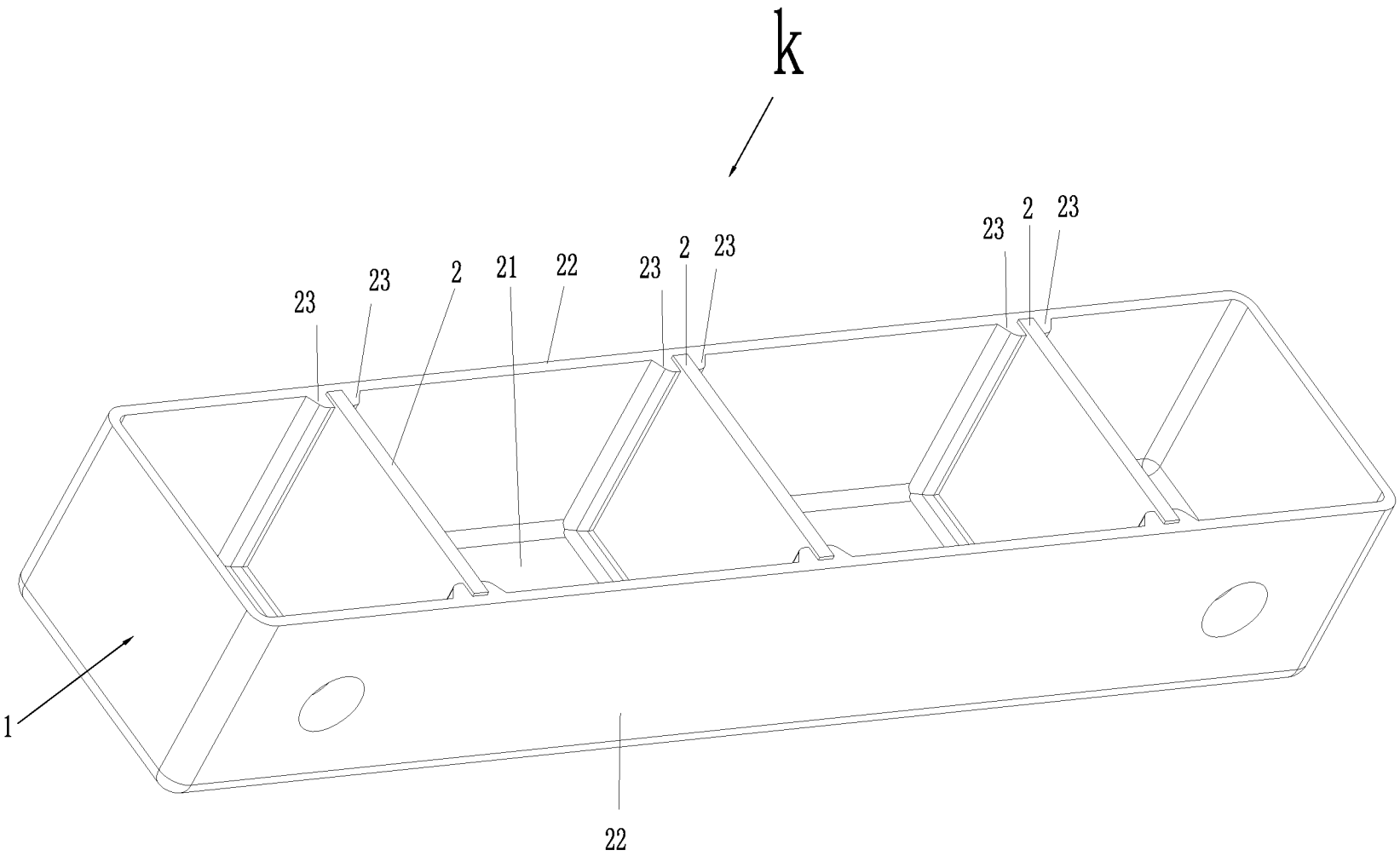
FIG. 1 is a perspective view of the reservoir according to a preferred embodiment of the present invention.
Figure 2:
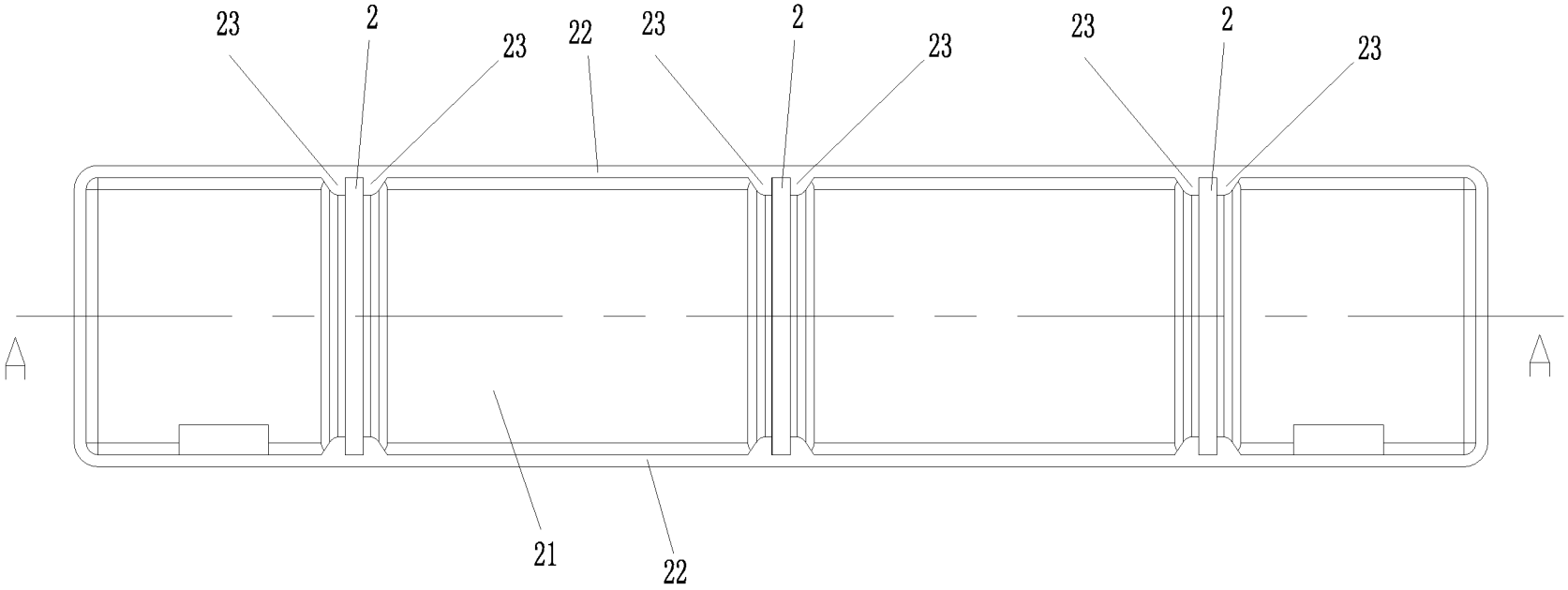
FIG. 2 is a view seen from the direction K in FIG. 1.
Figure 3:
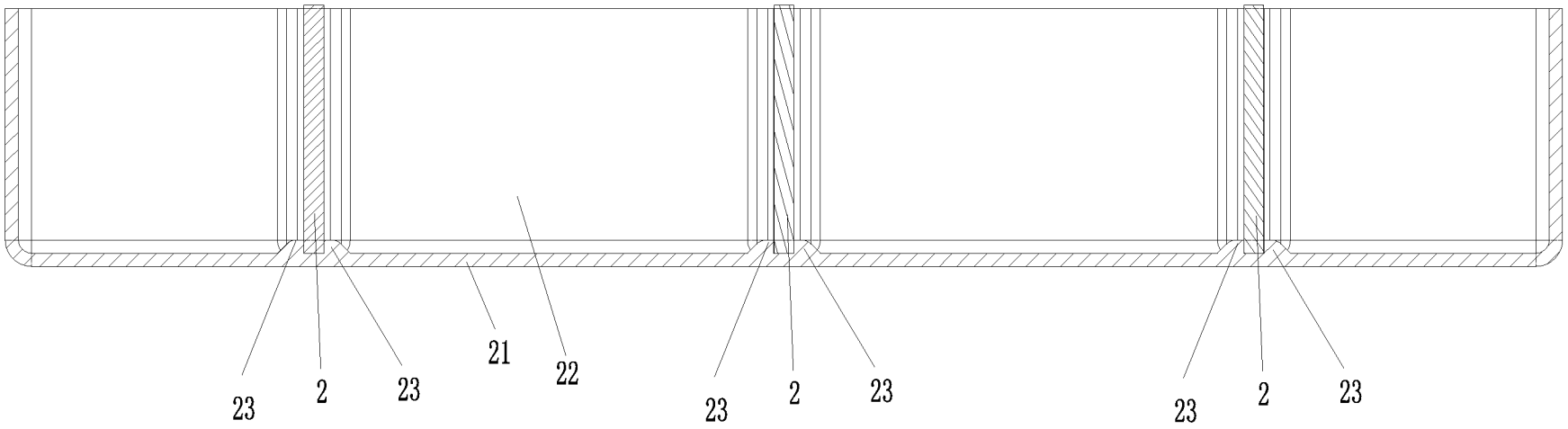
FIG. 3 is a cross-sectional view taken along line A-A in FIG. 2.
Figure 4:
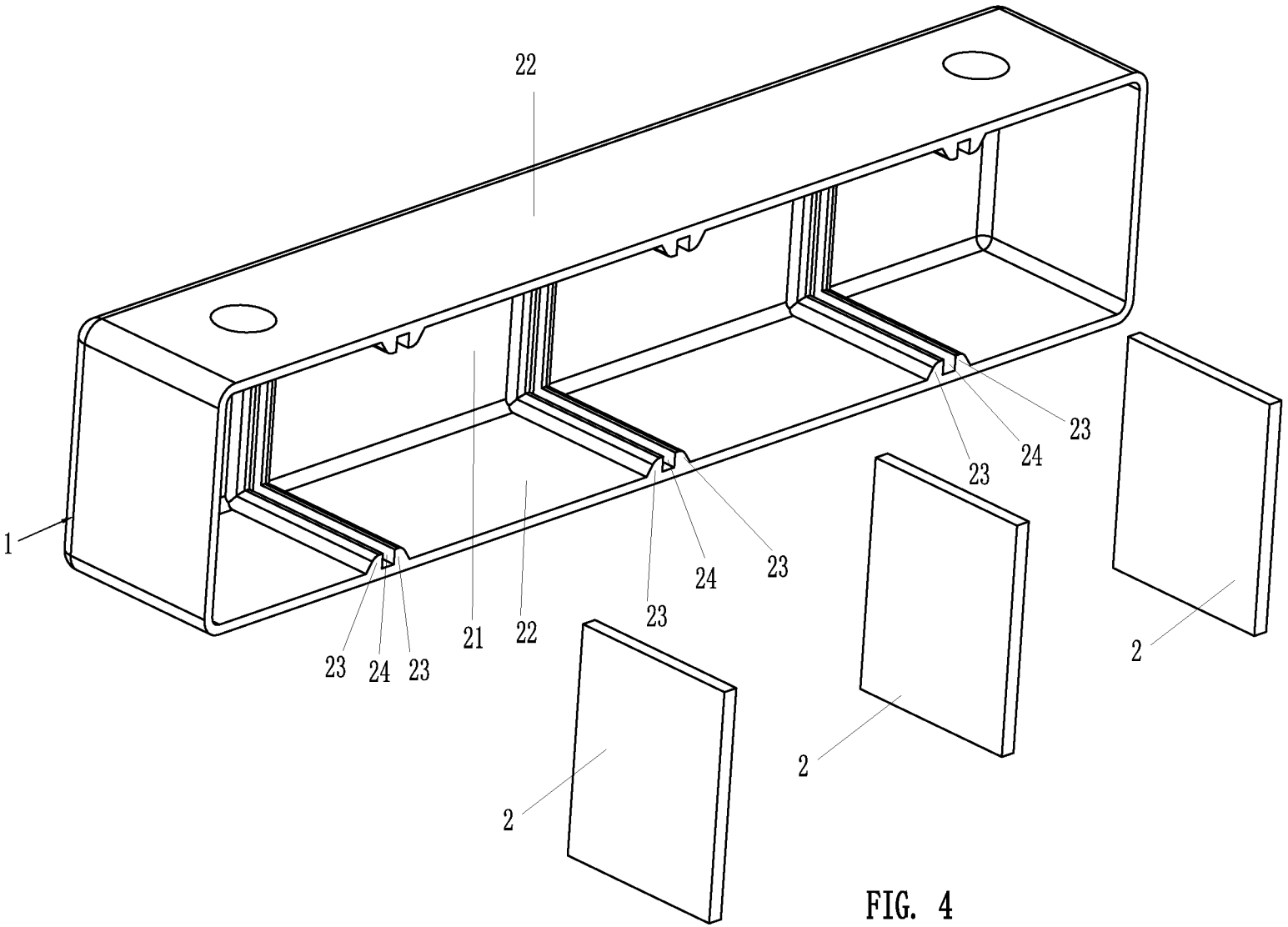
FIG. 4 is an exploded view of the reservoir according to the preferred embodiment of the present invention.
Figure 5:
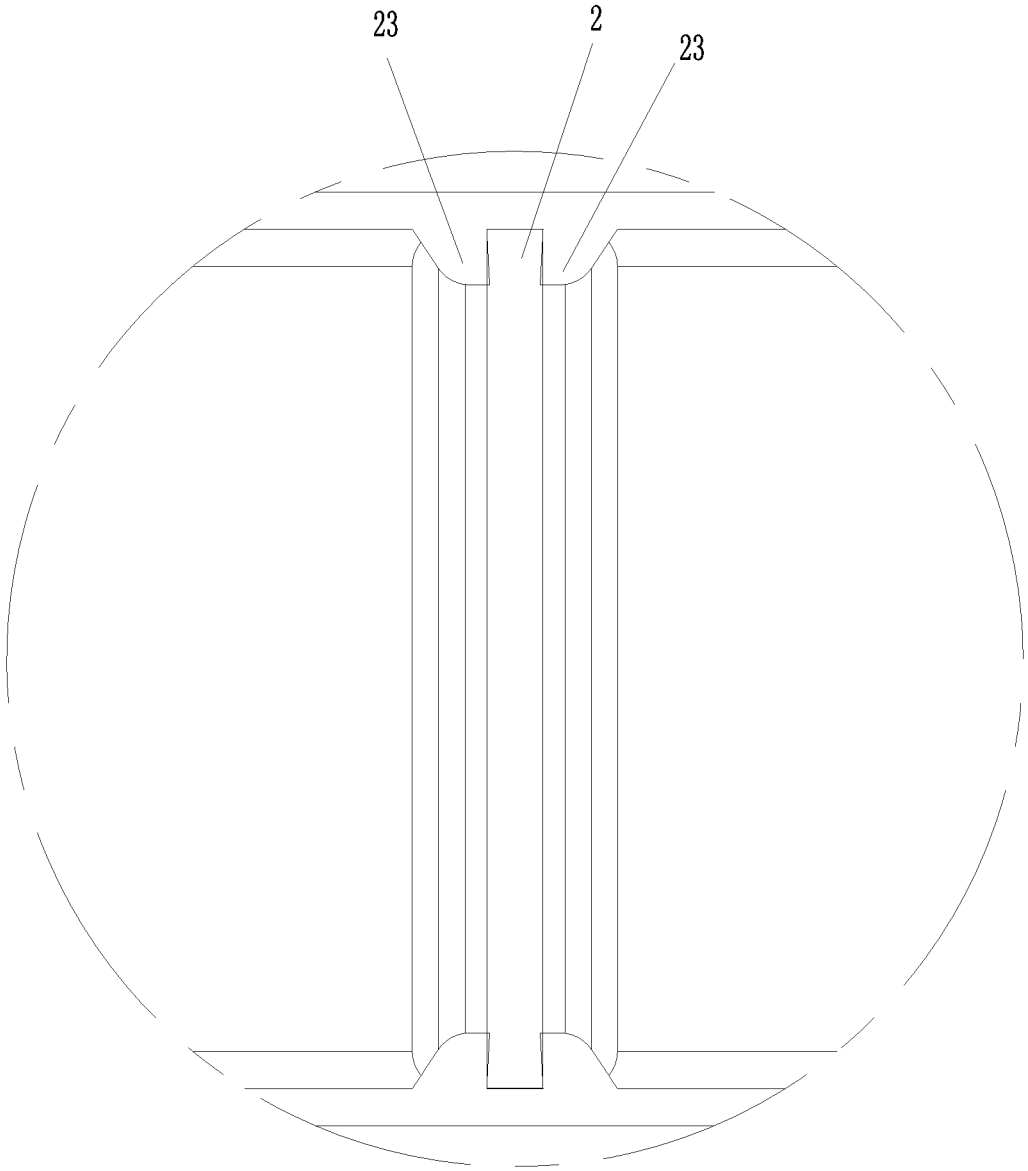
FIG. 5 is a partial enlarged view of FIG. 2.
Figure 6:
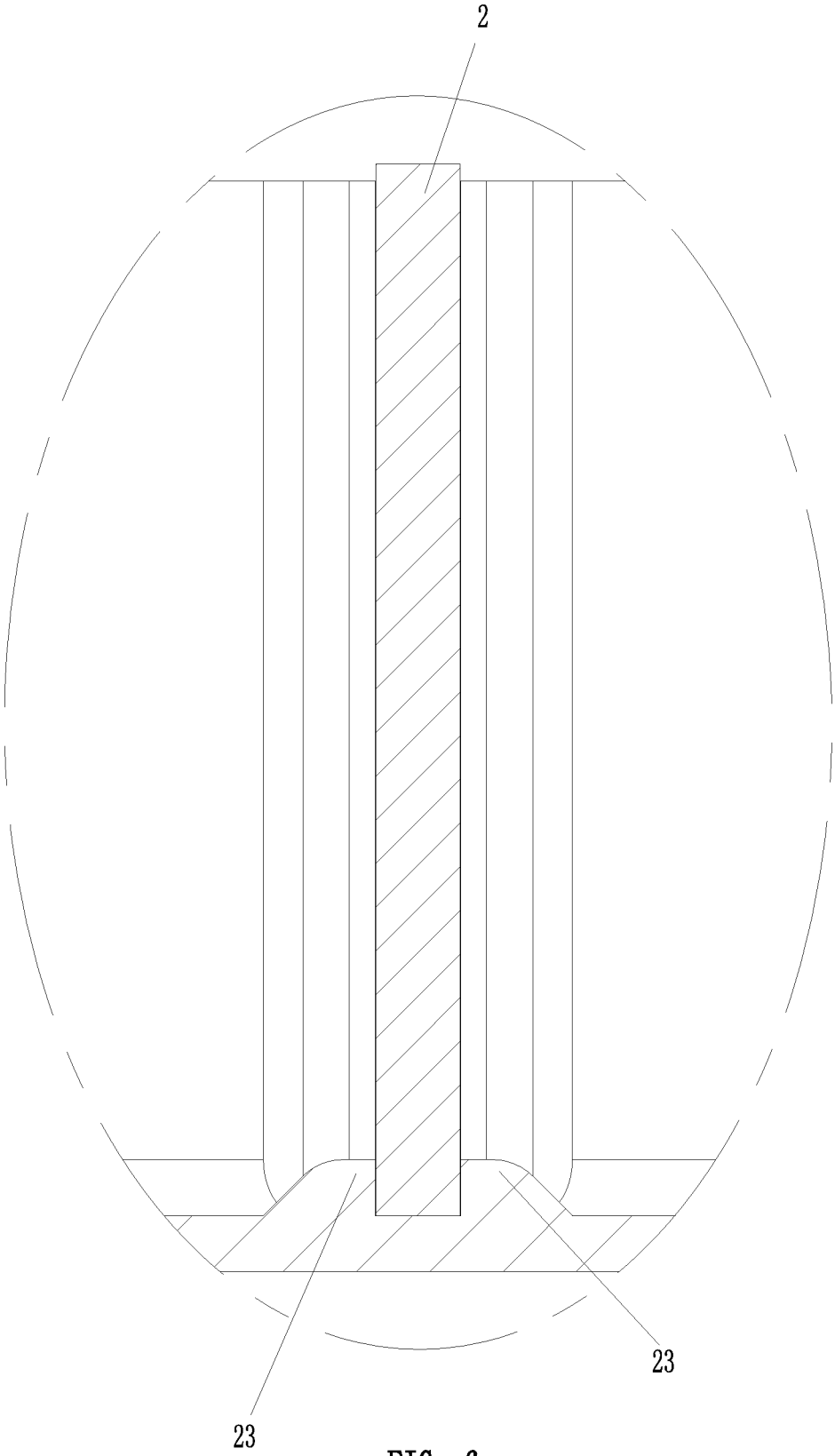
FIG. 6 is a partial enlarged view of FIG. 3.

FIGS. 1 to 8 show the specific structure of a preferred embodiment of the present invention.

First, referring to FIGS. 1 to 6, a reservoir comprises a reservoir body 1 and at least one partition 2 mounted in the reservoir body 1.

The reservoir body 1 has an end panel 21 and a peripheral side panel that is integrally formed and connected with the end panel 21. The peripheral side plate extends from the peripheral edge of the end panel 21 in the same direction. A liquid chamber is formed and surrounded by the end panel 21 and the peripheral side panel. The extension distal end of the peripheral side plate forms an opening of the liquid chamber. The peripheral side plate has two side plate portions 22 located on opposing two sides of the end panel 21. The reservoir body 1 is formed with U-shaped strips 23 extending along the inner walls of one side plate portion 22, the end panel 21 and the other side plate portion 22 in sequence. The U-shaped strips 23 are spaced and arranged in pairs. A groove 24 is formed between the paired U-shaped strips 23.

The partition 2 is inserted into the groove from the opening. The partition 2 is hermetically connected to the U-shaped strips 23, so as to divide the liquid chamber into divisional liquid chambers located on two sides of the partition 2. After the partition 2 is hermetically connected to the U-shaped strips 23, the partition 2 is exposed to the extension distal end of the peripheral side plate at the opening.

There are various actual processing methods for the partition 2 to be hermetically connected to the paired U-shaped strips 23. For example, after the partition 2 is inserted into the groove, the outer sides of the paired U-shaped strips 23 are pressed towards each other for clamping the partition 2. Preferably, in the pressing operation, the outer sides of the paired U-shaped strips 23 (namely, the opposing sides of the paired U-shaped strips) are subjected to opposing pressing forces. At the same time, the paired U-shaped strips 23 are pressed at the opening. High-temperature soldering can be adopted. After the partition 2 is inserted into the groove, the paired U-shaped strips 23 are fastened to the two sides of the partition 2 by passing through a high-temperature brazing furnace. In this processing mode, the partition 2 is made of a solderable composite material. Preferably, the partition 2 has a 3003 stainless aluminum substrate and a 4343 aluminum alloy dielectric layer compounded on the surface of the 3003 stainless aluminum substrate. When passing through the high-temperature brazing furnace, the partition 2 is soldered to the inner wall of the groove 24 through the 4343 aluminum alloy dielectric layer.

The reservoir body 1 is preferably formed by cold forging. The reservoir 1 is made of a heat-dissipating metal material. For example, stainless aluminum, iron or stainless steel can be selected.

Figure 7:
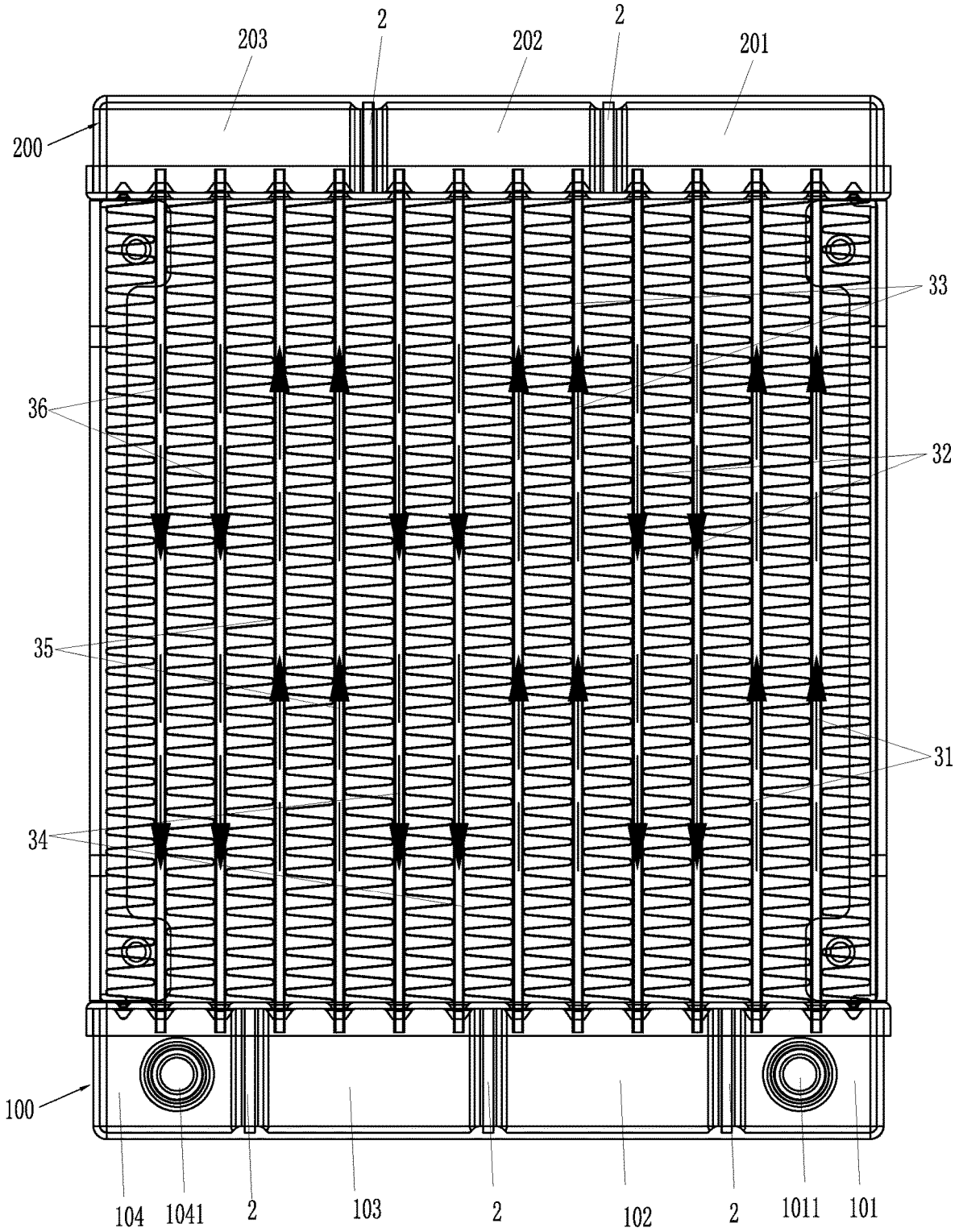
FIG. 7 is a schematic view of the liquid-cooling radiator according to the preferred embodiment of the present invention.
Figure 8:
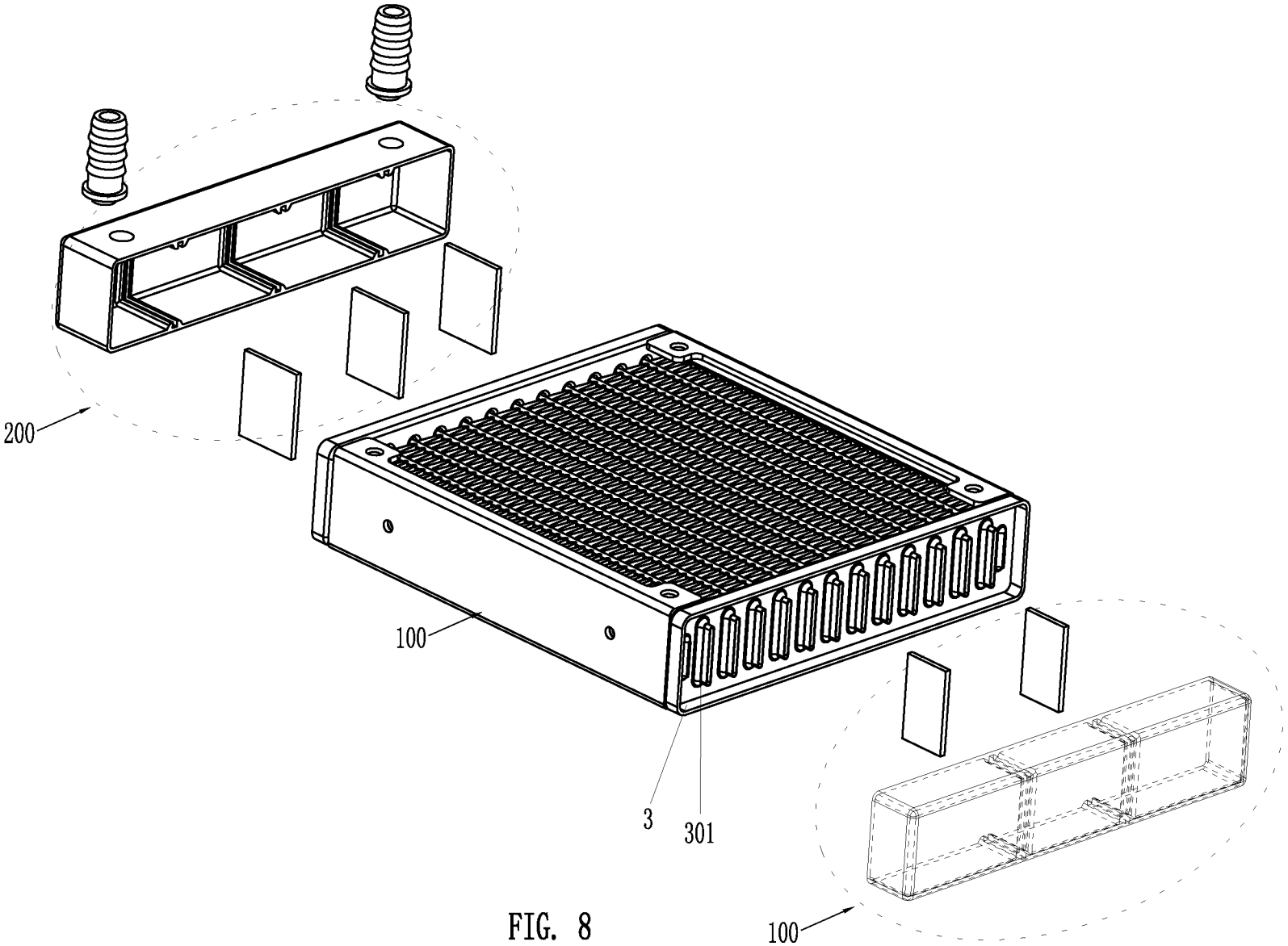
FIG. 8 is an exploded view of the liquid-cooling radiator according to the preferred embodiment of the present invention.

Please refer to FIG. 7 and FIG. 8, the present invention further discloses a liquid-cooling radiator, comprising a plurality of pairs of radiating pipes 300 arranged side by side and two reservoirs on respective two ends of the plurality of pairs of radiating pipes 300. The reservoir is the aforementioned reservoir. A reservoir cover 3 is hermetically connected to the opening of the liquid chamber of the reservoir body 1. The partition 2 is hermetically connected to the inner wall of the reservoir cover 3. The reservoir cover 3 has mounting holes 301 corresponding to the divisional liquid chambers. The two ends of the plurality of pairs of radiating pipes 300 are respectively connected to the corresponding mounting holes 301 to communicate with the corresponding divisional liquid chambers. Because the partition 2 is exposed to the extension distal end of the peripheral side plate at the opening, it can ensure the sealing assembly better after it is assembled on the two ends of the plurality of pairs of radiating pipes. The exposed end of the partition 2 is in close contact with the two ends of the plurality of pairs of radiating pipes, which can be better compatible with the tolerance of the reservoir and the two ends of the plurality of pairs of radiating pipes. Preferably, the peripheral side plate of the reservoir body 1 extends into the reservoir cover 3 to form a tight connection.

In this embodiment, the plurality of pairs of radiating pipes include six pairs of radiating pipes, defined as a pair of first radiating pipes 31, a pair of second radiating pipes 32, a pair of third radiating pipes 33, a pair of fourth radiating pipes 34, a pair of fifth radiating pipes 35, and a pair of sixth radiating pipes 36.

The two reservoirs mounted to the two ends of the plurality of pairs of radiating pipes 300 are defined as a first reservoir 100 and a second reservoir 200. The first reservoir 100 is provided with three sets of U-shaped strips 23, grooves 24 and partitions 2 to divide the first reservoir 100 into a first divisional liquid chamber 101, a second divisional liquid chamber 102, a third divisional liquid chamber 103 and a fourth divisional liquid chamber 104. The reservoir body 1 of the reservoir 100 has a liquid inlet 1011 corresponding to and communicating with the first divisional liquid chamber 101 and a liquid outlet 1041 corresponding to and communicating with the fourth divisional liquid chamber 104. The second reservoir 200 is provided with two sets of U-shaped strips 23, grooves 24 and partitions 2 to divide the second reservoir 200 into a fifth divisional liquid chamber 201, a sixth divisional liquid chamber 202, and a seventh divisional liquid chamber 203. The partitions 2 of the first reservoir 100 and the partitions 2 of the second reservoir 200 are arranged in a staggered manner.

The pair of first radiating pipes 31, the pair of second radiating pipes 32, the pair of third radiating pipes 33, the pair of fourth radiating pipes 34, the pair of fifth radiating pipes 35 and the pair of sixth radiating pipes 36 are all provided with radiating fins. First ends of the pair of first radiating pipes 31 communicate with the first divisional liquid chamber 101, and opposing second ends of the pair of first radiating pipes 31 communicate with the fifth divisional liquid chamber 201. First ends of the pair of second radiating pipes 32 communicate with the second divisional liquid chamber 102, and opposing second ends of the pair of second radiating pipes 32 communicate with the fifth divisional liquid chamber 201. First ends of the pair of third radiating pipes 33 communicate with the second divisional liquid chamber 102, and opposing second ends of the pair of third radiating pipes 33 communicate with the sixth divisional liquid chamber 202. First ends of the pair of fourth radiating pipes 34 communicate with the third divisional liquid chamber 103, and opposing second ends of the pair of fourth radiating pipes 34 communicate with the sixth divisional liquid chamber 202. First ends of the pair of fifth radiating pipes 35 communicate with the third divisional liquid chamber 103, and opposing second ends of the pair of fifth radiating pipes 35 communicate with the seventh divisional liquid chamber 203. First ends of the pair of sixth radiating pipes 36 communicate with the fourth divisional liquid chamber 104, and opposing second ends of the pair of sixth radiating pipes 36 communicate with the seventh divisional liquid chamber 203.

The working principle of this embodiment is described in detail as below.

In use, as shown in FIG. 7, the liquid with a higher temperature flows into the first divisional liquid chamber 101 from the liquid inlet 1011, and then flows through the pair of first radiating pipes 31, the fifth divisional liquid chamber 201, the pair of second radiating pipes 32, the second divisional liquid chamber 102, the pair of third radiating pipes 33, the sixth divisional liquid chamber 202, the pair of fourth radiating pipes 34, the third divisional liquid chamber 103, the pair of fifth radiating pipes 35, the seventh divisional liquid chamber 203 and the fourth divisional liquid chamber 104, and finally flows out from the liquid outlet 1041. The temperature of the liquid gradually decreases as it flows through the first divisional liquid chamber 101, the pair of first radiating pipes 31, the fifth divisional liquid chamber 201, the pair of second radiating pipes 32, the second divisional liquid chamber 102, the pair of third radiating pipes 33, the sixth divisional liquid chamber 202, the pair of fourth radiating pipes 34, the third divisional liquid chamber 103, the pair of fifth radiating pipes 35, the seventh divisional liquid chamber 203, and the fourth divisional liquid chamber 104. The temperature of the liquid output from the liquid outlet 1041 is lower, which achieves a good cooling and heat dissipation effect.

What is claimed is:

1. A reservoir, comprising a reservoir body and at least one partition mounted in the reservoir body;

the reservoir body having an end panel and a peripheral side panel that is integrally formed and connected with the end panel, the peripheral side plate extending from a peripheral edge of the end panel in a same direction, a liquid chamber being formed and surrounded by the end panel and the peripheral side panel, an extension distal end of the peripheral side plate forming an opening of the liquid chamber; the peripheral side plate having two side plate portions located on opposing two sides of the end panel, the reservoir body being formed with U-shaped strips extending along inner walls of one side plate portion, the end panel and the other side plate portion in sequence, the U-shaped strips being spaced and arranged in pairs, a groove being formed between the paired the U-shaped strips;

the partition being inserted into the groove from the opening and the partition being hermetically connected to the U-shaped strips, so as to divide the liquid chamber into divisional liquid chambers located on two sides of the partition.

2. The reservoir as claimed in claim 1, wherein after the partition is inserted into the groove, outer sides of the paired of the U-shaped strips are pressed towards each other for clamping the partition.

3. The reservoir as claimed in claim 1, wherein the reservoir is made of a heat-dissipating metal material.

4. The reservoir as claimed in claim 1, wherein after the partition is inserted into the groove, the paired U-shaped strips are fastened to the two sides of the partition by passing through a high-temperature brazing furnace.

5. The reservoir as claimed in claim 4, wherein the partition is made of a solderable composite material.

6. The reservoir as claimed in claim 5, wherein the partition has a 3003 stainless aluminum substrate and a 4343 aluminum alloy dielectric layer compounded on a surface of the 3003 stainless aluminum substrate; when passing through the high-temperature brazing furnace, the partition is soldered to an inner wall of the groove through the 4343 aluminum alloy dielectric layer.

7. The reservoir as claimed in claim 1, wherein the reservoir body is formed by cold forging.

8. The reservoir as claimed in claim 1, wherein after the partition is hermetically connected to the U-shaped strips, the partition is exposed to the extension distal end of the peripheral side plate at the opening.

9. A liquid-cooling radiator, comprising a plurality of pairs of radiating pipes arranged side by side and two reservoirs as claimed in claim 1 on respective two ends of the plurality of pairs of radiating pipes; a reservoir cover being hermetically connected to the opening of the liquid chamber of the reservoir body, the partition being hermetically connected to an inner wall of the reservoir cover, the reservoir cover having mounting holes corresponding to the divisional liquid chambers, the two ends of the plurality of pairs of radiating pipes being respectively connected to the corresponding mounting holes to communicate with the corresponding divisional liquid chambers.

10. The liquid-cooling radiator as claimed in claim 9, wherein the plurality of pairs of radiating pipes include six pairs of radiating pipes, defined as a pair of first radiating pipes, a pair of second radiating pipes, a pair of third radiating pipes, a pair of fourth radiating pipes, a pair of fifth radiating pipes and a pair of sixth radiating pipes;

the two reservoirs mounted to the two ends of the plurality of pairs of radiating pipes are defined as a first reservoir and a second reservoir, the first reservoir is provided with three sets of U-shaped strips, grooves and partitions to divide the first reservoir into a first divisional liquid chamber, a second divisional liquid chamber, a third divisional liquid chamber and a fourth divisional liquid chamber, the reservoir body of the reservoir has a liquid inlet corresponding to and communicating with the first divisional liquid chamber and a liquid outlet corresponding to and communicating with the fourth divisional liquid chamber;

the second reservoir is provided with two sets of U-shaped strips, grooves and partitions to divide the second reservoir into a fifth divisional liquid chamber, a sixth divisional liquid chamber and a seventh divisional liquid chamber, the partitions of the first reservoir and the partitions of the second reservoir are arranged in a staggered manner;

the pair of first radiating pipes, the pair of second radiating pipes, the pair of third radiating pipes, the pair of fourth radiating pipes, the pair of fifth radiating pipes and the pair of sixth radiating pipes are all provided with radiating fins; first ends of the pair of first radiating pipes communicate with the first divisional liquid chamber, opposing second ends of the pair of first radiating pipes communicate with the fifth divisional liquid chamber; first ends of the pair of second radiating pipes communicate with the second divisional liquid chamber, opposing second ends of the pair of second radiating pipes communicate with the fifth divisional liquid chamber; first ends of the pair of third radiating pipes communicate with the second divisional liquid chamber, opposing second ends of the pair of third radiating pipes communicate with the sixth divisional liquid chamber; first ends of the pair of fourth radiating pipes communicate with the third divisional liquid chamber, opposing second ends of the pair of fourth radiating pipes communicate with the sixth divisional liquid chamber; first ends of the pair of fifth radiating pipes communicate with the third divisional liquid chamber, opposing second ends of the pair of fifth radiating pipes communicate with the seventh divisional liquid chamber; first ends of the pair of sixth radiating pipes communicate with the fourth divisional liquid chamber, and opposing second ends of the pair of sixth radiating pipes communicate with the seventh divisional liquid chamber.

* * * * *